United States Patent [19]

Erickson

[11] 4,101,246

[45] Jul. 18, 1978

[54] VORTEX JET PUMP

[75] Inventor: John W. Erickson, Huntington Beach, Calif.

[73] Assignee: Kobe, Inc., Huntington Park, Calif.

[21] Appl. No.: 691,861

[22] Filed: Jun. 1, 1976

Related U.S. Application Data

[63] Continuation-in-part of Ser. No. 527,219, Nov. 26, 1974, abandoned.

[51] Int. Cl.[2] ..... F04F 5/10; F04F 5/42; F04F 5/46

[52] U.S. Cl. ..... 417/171

[58] Field of Search ..... 417/171, 194, 163, 179, 417/197, 77, 186, 151, 163, 186

[56] References Cited

U.S. PATENT DOCUMENTS

| | | | |
|---|---|---|---|
| 334,597 | 1/1886 | Marsh | 417/197 X |
| 1,175,462 | 3/1916 | Leblanc | 417/151 |
| 2,892,582 | 6/1959 | O'Rourke | 417/179 |
| 3,089,637 | 5/1963 | Bell | 417/368 |
| 3,301,606 | 1/1967 | Bruno | 417/171 UX |
| 3,672,790 | 6/1972 | White | 417/197 X |

*Primary Examiner*—John J. Vrablik

*Assistant Examiner*—Richard E. Gluck

*Attorney, Agent, or Firm*—Christie, Parker & Hale

[57] ABSTRACT

A vortex jet pump is provided in which circumferential flow in a fluid flow passage through the pump is induced by a tangential power liquid jet inlet into the passage between its suction inlet and its outlet. The pump, which has no moving parts, has a housing providing a fluid flow passage between a pumped fluid suction inlet and a pumped fluid outlet downstream therefrom. Downstream from the power liquid jet inlet there is a throat in the passage having a flow cross section less than the flow cross section of the passage adjacent the power inlet jet inlet. A diffuser section is provided in the passage downstream from the throat and includes means for converting primarily circumferential fluid flow to primarily axial fluid flow in the passage. Preferably such means comprises fixed vanes in the passage downstream for the power liquid let inlet. Means are provided upstream from the power liquid jet inlet for injecting fluid into the passage in a primarily tangential direction for initiating circumferential flow in the passage. The velocity head of the injected fluid is less than the velocity head of the power liquid injected through the jet inlet to minimize cavitation.

11 Claims, 4 Drawing Figures

VORTEX JET PUMP

BACKGROUND OF THE INVENTION

This invention relates to a jet pump of novel construction, particularly useful for pumping fluids from an oil well or the like. This application is a continuation-in-part of co-pending U.S. patent application Ser. No. 527,219, filed Nov. 26, 1974, now abandoned. The subject matter of the aforementioned co-pending application is hereby incorporated by reference.

A jet pump is sometimes employed as a submerged pump in an oil well for pumping produced fluids to the surface. Such a jet pump has a suction inlet through which produced fluids, which may include oil, gas, and/or water, are drawn. A high pressure power liquid, which is typically crude oil, is injected through a power liquid jet inlet into a flow passage through the jet pump connecting the production fluid suction inlet and the pump outlet. The power liquid is pumped by high pressure pumps at the ground surface and transmitted to the jet pump by tubing extending down the well to be produced. Momentum of the power liquid injected through the jet inlet is at least partly transferred to the production fluid, thereby raising its velocity head. The mixed fluid from the suction inlet and from the jet inlet passes through a throat having a flow cross section smaller than the flow cross section at the point of injection of the power liquid. Downstream from this throat there is a diffuser section having a gradually increasing flow cross section so that the velocity head of the mixed fluids is converted to pressure head for producing fluids from the well.

A significant problem in the jet pump art is cavitation in the pump. This involves the formation of vapor bubbles in low static pressure regions in the pump followed by collapse of the vapor bubbles as the velocity head is converted to static pressure head in the diffuser. Such cavitation reduces pump efficiency and can lead to severe damage to the pump if it persists. In ordinary jet pumps the power liquid flow rate can be reduced to suppress cavitation. This, however, leads to low production rates and inefficient operation. Alternatively the jet pump can be submerged in liquids in the well on the suction side of the jet pump. This increases the pressure on the suction side of the pump and decreases the tendency to form vapor bubbles when pressure is reduced due to injection of high velocity power liquid. It is often undesirable to submerge a jet pump enough to prevent cavitation since this requires a large column of liquid in the well. This column of liquid can reduce the production rate of fluid from the producing formation, again reducing total production and leading to inefficiency.

It is therefore desirable to provide a jet pump for use in oil wells and the like which is less susceptible to cavitation than conventional jet pumps.

BRIEF SUMMARY OF THE INVENTION

There is, therefore, provided in practice of this invention, according to presently preferred embodiments, a vortex jet pump having a suction inlet, a mixed fluid outlet downstream from the suction inlet and a fluid flow passage therebetween. A power liquid jet inlet injects power liquid into the fluid passage in a generally tangential direction for inducing circumferential motion in fluid flowing through the passage. A throat section in the fluid passage downstream from the jet inlet has a flow cross section less than the flow cross section of the passage adjacent the power liquid jet inlet, and downstream therefrom there is a diffuser section including means for converting primarily circumferential fluid flow to primarily axial fluid flow in the passage. Means are provided upstream from the power liquid jet inlet for initiating a component of circumferential flow in fluid in the passage in the same sense of rotation as the tangential direction of the power liquid jet inlet. The circumferential motion in the fluid raises its effective pressure adjacent the power liquid jet inlet and thereby suppresses cavitation.

DRAWINGS

These and other features and advantages of the present invention will be appreciated as the same becomes better understood by reference to the following detailed description of presently preferred embodiments when considered in connection with the accompanying drawings wherein.

DESCRIPTION

Figure 1:
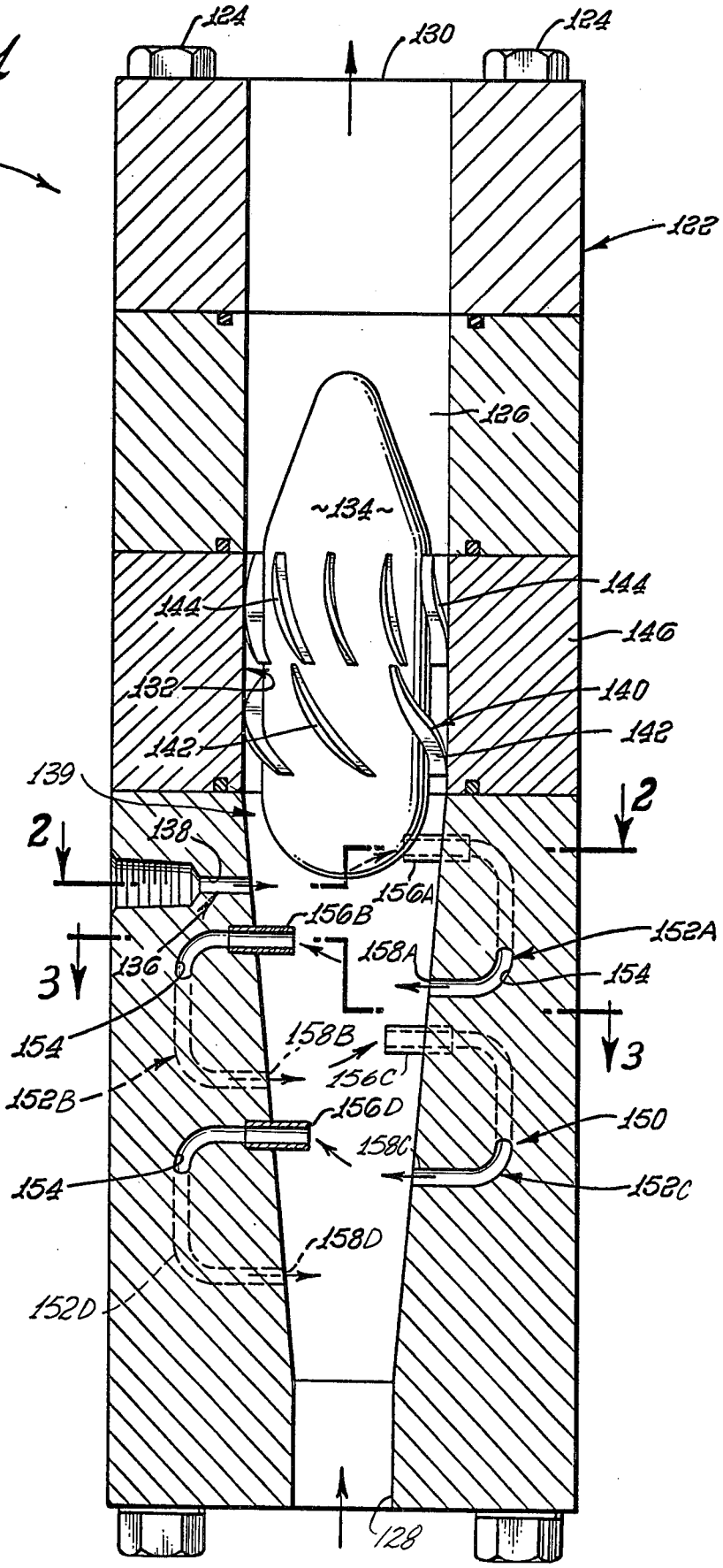
FIG. 1 is a longitudinal cross section of a vortex jet pump which embodies this invention.
Figure 2:
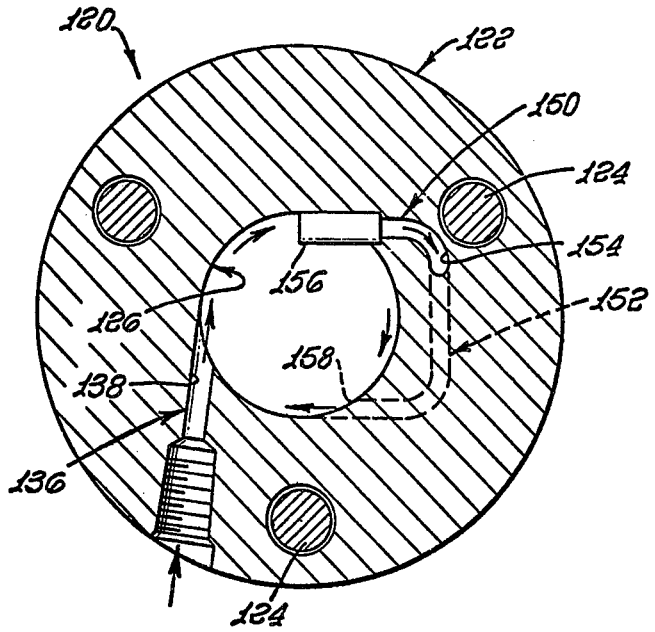
FIG. 2 is a transverse cross section of the vortex jet pump of FIG. 1 at line 2—2.
Figure 3:
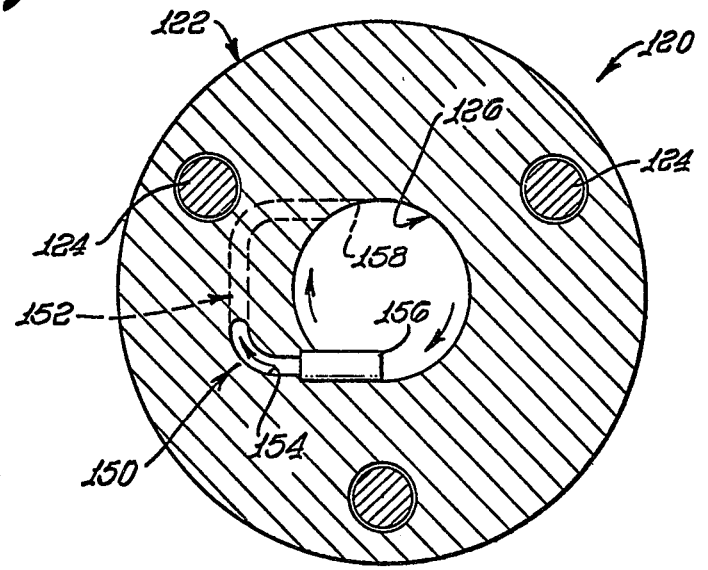
FIG. 3 is a transverse cross section of the vortex jet pump of FIG. 1 at line 3—3.

FIGS. 1 to 3 illustrate a vortex jet pump 120 which includes a housing 122 composed of a stack of annular housing sections in axial alignment and suitably secured together as by bolts 124. The housing provides a generally axial fluid flow passage 126 therethrough which includes a suction inlet 128 at one end for a fluid to be pumped, an outlet 130 at its other end for pumped fluid, and an annular section 132 of the passage in between the suction inlet 128 and the mixed fluid outlet 130. The suction inlet 128, the annular passage 132 and the mixed fluid outlet 130 are all co-axial. The outer wall of the annular passage 132 is formed by the sectional housing 122 and the inner wall thereof is formed by a streamlined core or hub 134 in the fluid flow passage.

The housing 122 has a tangential power liquid jet inlet 136 which communicates with the fluid flow passage 126 through the vortex jet pump. The power liquid jet inlet injects a tangential jet of power liquid into the fluid flow passage for inducing circumferential motion in fluid therein. The tangential injecting jet inlet 136 comprises an inlet passage 138 which, as seen in FIG. 2, is tangential to the fluid flow passage 126.

Downstream from the power liquid jet inlet 136 there is a throat section of the fluid flow passage indicated generally by reference numeral 139. The annulus between the wall of the housing 122 and the streamlined core or hub 134 has a smaller effective flow cross section at the throat 139 than does the fluid flow passage 126 adjacent the power liquid jet inlet. The annular throat section 139 assures good momentum transfer between power liquid injected through the jet inlet 136 and fluid drawn through the suction inlet 128.

The vortex jet pump 120 includes a vane means 140 in the annular passage 132 downstream from the tangential power liquid jet inlet 136 and the throat section 139. These vane means 140 convert generally circumferential motion in the fluid flowing through the annular passage into generally axial flow through the annular passage towards the outlet 130. The vane means provide a diffuser action downstream from the throat section 139 for converting velocity head in the fluid passing through the annular passage to static pressure head. Such diffuser action occurs as in conventional stator blades by gradually increasing the effective flow cross section of the annular passage and decreasing flow velocity as the direction of fluid flow changes from circumferential to axial.

The vane means 140 comprises curved vanes 142 and 144 in the annular passage, the vanes 144 being axially spaced downstream from the vanes 142. The vanes 142 are circumferentially spaced apart as are the vanes 144. The hub 134 with the vanes thereon is held in place by frictional engagement of the vanes 142 and 144 with the corresponding housing section 146. Such frictional engagement may be achieved by pressing the hub and vane assembly into the housing 146 or by shrinking the housing section 146 on to the hub and vane assembly prior to assembling the various annular housing sections making up the complete housing 122.

The pump 120 also includes vortex booster means 150 generally in between the suction inlet 128 and the power liquid jet inlet 136 for supplementing the action of the power liquid jet in imparting circumferential motion to the fluid flowing through the flow passage 126 from the suction inlet 128 toward the annular passage 132. Generally speaking, the centrifugal booster means 150 takes advantage of the fact that the pressure in the flow path 126 progressively increases in the downstream direction due to the vortex action and utilizes such progressively increasing downstream pressure to provide supplementary tangential fluid jets acting in the same direction as, and enhancing the effect of, the tangential power liquid jet from the jet injecting means 136.

More particularly the centrifugal booster means comprises a series of axially and circumferentially spaced boosting circuits 152 located between the inlet 128 and the power liquid injecting jet inlet 136. Each boosting circuit 152 comprises an auxiliary pasage 154 in the housing 122. Each auxiliary passage 154 has an inlet end 156 aligned tangentially with the fluid flow passage 126. The inlets 156 are aligned tangentially in the opposite sense of rotation from the power liquid jet inlet 136. Thus, each inlet 156 captures a portion of the circumferential velocity head of fluid flowing in the fluid flow passage 126.

Each auxiliary passage 154 of the booster means also has a tangential outlet end 158 upstream from its inlet end 156 for injecting fluid into the flow passage 126 in a tangential direction having the same sense of rotation as the power liquid jet inlet 136. Thus, the fluid injected into flow passage 126 by each boosting circuit 152 supplements the action of the power liquid jet produced by the main tangential power liquid jet inlet 136 to impart additional circumferential motion to the fluid flowing through the flow passage 126 toward the upstream end of the annular passage 132.

The inlet 156A of the first boosting circuit 152 is downstream from the power liquid jet inlet 136. The outlet 158A of this first boosting circuit is upstream from the power liquid jet inlet 136. The inlet 156B of the second booster circuit 152B is downstream from the outlet 158A of the first booster circuit 152A, and its outlet 158B is upstream from the outlet 158A of the first booster circuit. The inlet 156C of the third booster circuit 152C is downstream from the outlet 158B of the second booster circuit 152B. Similarly its outlet 158C is upstream from the outlet 158B of the second booster circuit 152B. The inlet 156B of the fourth booster circuit 152D is downstream from the outlet 158C of the third booster circuit 152C. The outlet 158D of the fourth booster circuit 152D is upstream from the outlet 158C of the third booster circuit 152C.

Thus, the first booster circuit 152A captures some of the circumferential velocity head of the fluid in the flow passage 126 downstream from the power liquid jet inlet 136. The booster circuit transmits this head to a point upstream from the power liquid jet inlet, thereby inducing circumferential motion in the fluid in the flow passage before it reaches the power liquid jet inlet. Similarly the second booster circuit 152B captures some of the velocity head of circumferential motion of fluid in the passage downstream from the outlet 158A of the first booster circuit 152A. This velocity head is in turn conveyed to a point upstream from the inlet 156C of the third booster circuit 152C. Thus, each booster circuit captures some of the downstream circumferential velocity head and conveys it upstream. This results in a gradual and progressive increase in circumferential flow velocity in the downstream direction. That is, a vortex is gradually induced in the flow passage as fluid flows from the suction inlet 128 towards the power liquid jet inlet 136.

The centripetal acceleration of the circumferentially flowing fluid in the flow passage gradually increases as the fluid proceeds from the suction inlet 128 to the power liquid jet inlet 136. This gradually increases the effective pressure of the fluid near the walls of the fluid flow passage 126. This increase in effective pressure due to the vortex at the wall where the power liquid jet enters tangentially effectively suppresses cavitation without requiring deep submergence of the vortex jet pump.

The booster circuits gradually increase the speed of the vortex and the effective pressure in the vortex jet pump to suppress cavitation throughout. It will be noted in this regard that the velocity head of the fluid injected upstream from the power liquid jet inlet is less than the velocity head of the power liquid injected through such jet inlet 136. This is the case since only a portion of the velocity head of liquid downstream from the jet inlet is transmitted by the first booster circuit 152 to a point upstream therefrom. The same is true of each booster circuit in the pump. Thus, since the effective pressure of the liquid in the flow passage is least near the suction inlet 128 the velocity head of fluid injected tangentially therein is also least. The velocity head of each successive tangential fluid jet in a downstream direction is greater than the velocity head of the next jet upstream therefrom. Thus, at each stage cavitation is suppressed.

Although the booster circuit arrangement provided herein extracts a portion of the fluid in the fluid flow passage upstream from the diffuser section of the jet pump, it will be apparent that if desired, a portion of fluid can be recirculated from a region downstream from the diffuser into the fluid flow passage upstream from the power liquid jet inlet. In such an arrangement the relatively high static pressure in the flow passage downstream from the diffuser serves to initiate circumferential motion in the fluid upstream from the power liquid jet inlet. It will also be noted that a booster circuit can be employed with a single inlet downstream from the power liquid jet inlet and a plurality of tangential outlets upstream from the power liquid jet inlet, somewhat in the manner of the embodiment illustrated hereinafter in FIG. 4.

In the illustrated embodiment, the booster circuits 152 are incorporated in the housing 122 of the vortex jet pump. It will be apparent that if desired the booster circuits can be incorporated in an elongated hub or core in a fluid flow passage through a vortex jet pump. In such a case (as disclosed in FIG. 12 of the aforementioned parent application) the vortex action is gradually induced in an annular passage between the core and the pump housing. Similarly (as disclosed in FIGS. 10 and 11 of the aforementioned parent application) the booster circuits can be arranged to have inlets in the housing and outlets in the core or vice versa with flow passages therebetween. A variety of such combinations will be apparent to one skilled in the art. It will also be noted that a plurality of vortex jet pumps as herein disclosed can be serially arranged for progressively increasing the pressure of the fluid being pumped.

Figure 4:
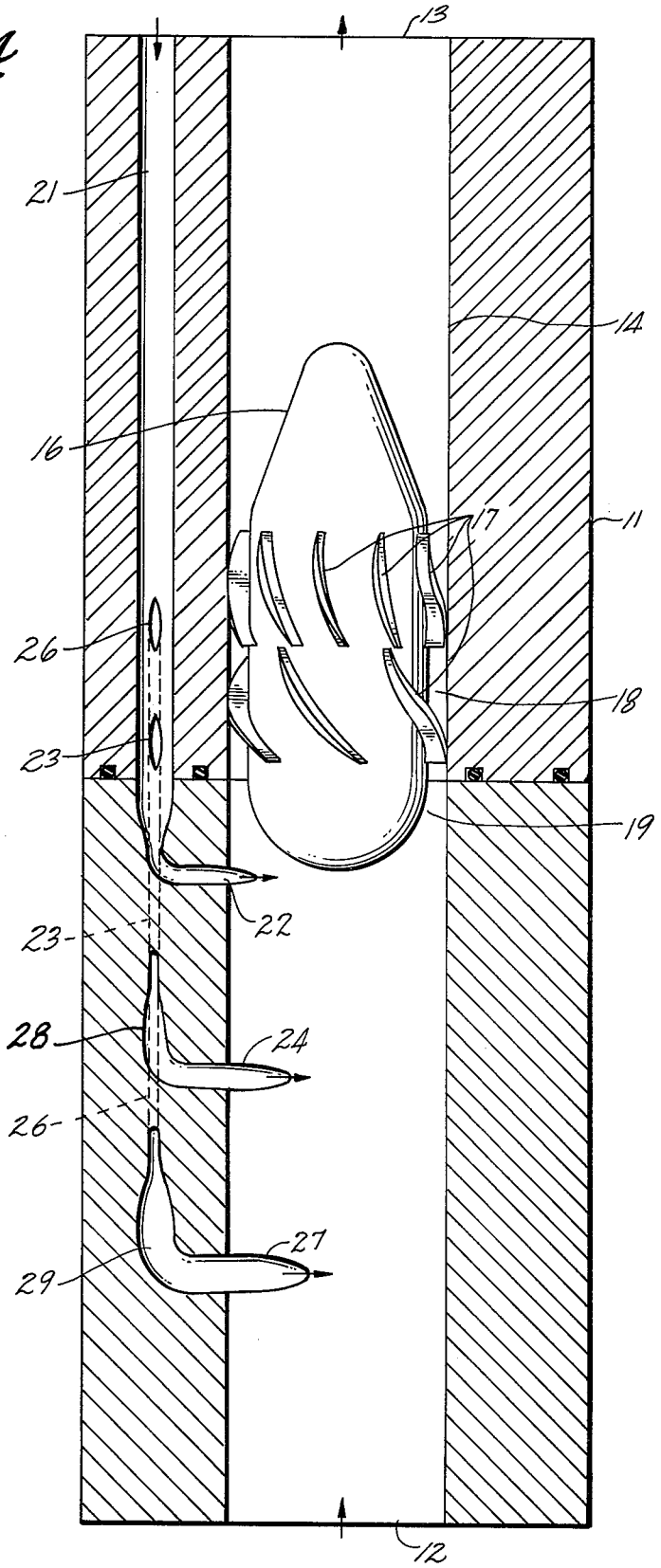
FIG. 4 is a longitudinal cross section of another embodiment of vortex jet pump incorporating principles of this invention.

FIG. 4 illustrates semi-schematically in longitudinal cross section another embodiment of vortex jet pump incorporating principles of this invention. As illustrated in this embodiment, the pump has an elongated housing 11 having a suction inlet 12 at one end and a mixed fluid outlet 13 at the other end. A fluid flow passage 14 extends therebetween. A streamlined hub 16 is mounted in the flow passage 14 and fixed vanes 17 are mounted in the annular passage 18 between the hub 16 and the wall of the passage 14. The presence of the hub 16 in the flow passage provides a throat 19 upstream from the diffuser provided by the stator vanes 17 in the annular passage.

A power liquid inlet passage 21 provides power liquid to a tangential power liquid jet inlet 22 which injects power liquid into the flow passage 14 in a generally tangential direction.

A branch passage 23 extends from the power liquid passage 21 to a second power liquid inlet 24 upstream from the main power liquid jet inlet 22. This second power liquid jet inlet 24 also directs power liquid into the flow path 14 in a tangential direction in the same sense of rotation as the main power liquid jet inlet 22. Similarly, another branch passage 26 communicates between the power liquid inlet passage 21 and a third power liquid inlet 27 into the fluid flow passage. This third power liquid inlet also directs power liquid generally tangentially into the flow passage for inducing a vortex in fluid passing therethrough.

Each of the branch passages 23 and 26 has at least a portion having a smaller flow cross section than the fluid flow passage 21 to the main power liquid jet inlet 22 thereby limiting the quantity of power liquid flowing through each branch passage. The first branch passage leading to the second power liquid inlet 24 has a gradually diverging diffuser section 28 for reducing the velocity head of power liquid injected into the flow passage through the second power liquid inlet 24. This assures that the velocity head of the power liquid injected through the second tangential inlet 24 is less than the velocity head of the power liquid injected through the main power liquid jet inlet 22. Similarly, the second branch passage 26 leading to the third power liquid inlet has a diverging diffuser section 29 to assure that the velocity head of liquid injected through the third power liquid inlet 27 is less than the velocity head of power liquid injected through the second tangential inlet 24.

Such an arrangement with gradually increasing velocity head through the several power liquid jet inlets progressing downstream results in a gradually increasing vortex action in the fluid flow passage thorugh the vortex jet pump. The circumferential motion of fluid in the vortex increases the effective pressure at each downstream tangential inlet thereby helping suppress cavitation. It will be apparent that the gradually increasing vortex action and other flow characteristics of the vortex jet pump, illustrated in FIG. 4, are similar to the actions occuring in the vortex jet pump hereinabove described and illustrated in FIG. 1.

It will be apparent to one skilled in the art that the illustration of FIG. 4 is a semi-schematic and other arrangements of power liquid passages in the housing of the vortex jet pump can be provided for convenience in manufacture.

It might be thought that fixed stator blades upstream from the power liquid jet inlet could be used for initiating circumferential motion in the fluid being pumped to form a vortex at the power liquid jet inlet. Such a vortex can be induced but this does not result in suppression of cavitation. Any increase in pressure adjacent to the power liquid jet inlet by such vortex is offset by decrease in static pressure since such stators cannot add energy to the fluid being pumped and, if anything, cause a slight decrease in energy by reason of fluid friction. By injecting fluid tangentially upstream from the main power liquid jet inlet, energy is added to the fluid pumped upstream from the power fluid jet inlet.

Although limited embodiments of vortex jet pump have been described and illustrated herein, many modifications and variations will be apparent to one skilled in the art. For example, the generally tangential injection of fluid can have some downstream component as well as indicated in FIG. 1 of the aforementioned parent application. Other such variations are disclosed in the parent application and many others can be provided. It is, therefore, to be understood that within the scope of the appended claims the invention may be practiced otherwise than as specifically described.

What is claimed is:

1. A fluid jet pump comprising:

a pumped fluid suction inlet;

a fluid outlet downstream from the suction inlet;

a fluid flow passage between the suction inlet and the outlet;

a power liquid jet inlet for injecting power liquid into the fluid flow passage in a generally tangential direction;

a throat in the fluid flow passage downstream from the power liquid jet inlet having a flow cross section less than the flow cross section of the passage adjacent the power liquid jet inlet;

a diffuser section in the fluid flow passage downstream from the throat and including means for converting primarily circumferential fluid flow to primarily axial fluid flow in the passage;

means upstream from the power liquid jet inlet for initiating a component of circumferential flow in fluid in the passage in the same sense as the tangential direction of the power liquid jet inlet, comprising:

means for extracting a portion of fluid from the fluid flow passage downstream from the power liquid jet inlet; and means for injecting the portion of fluid into the fluid flow passage, upstream from the power liquid jet inlet at least partly tangentially and with a lower velocity head than power liquid injected through the power fluid jet inlet; and means upstream from the power liquid jet inlet for injecting fluid into the passage in a primarily tangential direction with the velocity head of the injected fluid being less than the velocity head of the power liquid injected through the jet inlet.

2. A fluid jet pump as recited in claim 1 wherein the means for extracting comprises a fluid entrance facing tangentially in the fluid flow passage in the opposite sense of rotation from the power liquid jet inlet.

3. A fluid jet pump comprising:

a pumped fluid suction inlet;

a fluid outlet downstream from the suction inlet;

a fluid flow passage between the suction inlet and the outlet;

a power liquid jet inlet for injecting power liquid into the fluid flow passage in a generally tangential direction;

a throat in the fluid passage downstream from the power liquid jet inlet having a flow cross section less than the flow cross section of the passage adjacent the power liquid jet inlet;

a diffuser section in the fluid flow passage downstream from the throat and including means for converting primarily circumferential fluid flow to primarily axial fluid flow in the passage; and a plurality of means upstream from the power liquid jet inlet for injecting fluid into the fluid flow passage in a generally tangential direction upstream from the power liquid jet inlet, each successive means for injecting, in a downstream sequence, having a higher fluid velocity head than such means for injecting upstream therefrom for initiating a component of circumferential flow in fluid in the passage in the same sense as the tangential direction of the power liquid jet inlet, the velocity head of the injected fluid being less than the velocity head of the power liquid injected through the jet inlet; and wherein the means for injecting comprise a plurality of booster circuits each extracting fluid from the fluid flow passage at a downstream location and reinjecting such fluid at an upstream location.

4. A fluid jet pump comprising:

a pumped fluid suction inlet;

a fluid outlet;

a fluid flow passage between the suction inlet and the outlet;

a power liquid jet inlet aligned with the fluid flow passage in a direction for injecting power liquid in a generally tangential direction adjacent a wall of the fluid flow passage;

means for extracting a portion of fluid from the fluid flow passage downstream from the power liquid jet inlet;

means for injecting the portion of fluid into the fluid flow passage in a generally tangential direction upstream from the power liquid jet inlet, the velocity head of the injected fluid being less than the velocity head of the fluid injected through the power liquid jet inlet; and means for converting circumferential flow in the passage to axial flow in the passage downstream from the power liquid jet inlet.

5. A fluid jet pump as recited in claim 4 wherein the means for extracting comprises a fluid entrance facing tangentially in the fluid flow passage in the opposite sense of rotation from the power liquid jet inlet.

6. A fluid jet pump comprising:

a pumped fluid suction inlet;

a fluid outlet;

a fluid flow passage between the suction inlet and the outlet;

a power liquid jet inlet aligned with the fluid flow passage in a direction for injecting power liquid in a generally tangential direction adjacent a wall of the fluid flow passage;

means for injecting fluid into the fluid flow passage in a generally tangential direction upstream from the power liquid jet inlet, the velocity head of the injected fluid being less than the velocity head of the fluid injected through the power liquid jet inlet, the means for injecting comprising a plurality of booster circuits, each extracting fluid from the fluid flow passage at a downstream location and reinjecting such fluid at an upstream location; and means for converting circumferential flow in the passage to axial flow in the passage downstream from the power liquid jet inlet.

7. A vortex jet pump comprising:

a pumped fluid suction inlet;

a fluid outlet downstream from the suction inlet;

a fluid passage between the suction inlet and the outlet;

a power liquid jet inlet for injecting power liquid into the fluid passage in a generally tangential direction;

a throat in the fluid passage downstream from the power liquid jet inlet having a flow cross section less than the flow cross section of the passage adjacent the power liquid jet inlet;

a diffuser section in the fluid passage downstream from the throat and including means for converting primarily circumferential fluid flow to primarily axial fluid flow in the passage;

means for extracting a portion of fluid from the fluid passage downstream from the power liquid jet inlet; and means upstream from the power liquid jet inlet for injecting the portion of fluid into the fluid passage upstream from the power liquid jet inlet in a primarily tangential direction, with the velocity head of the injected fluid being less than the velocity head of the power liquid injected through the power liquid jet inlet.

8. A vortex jet pump as recited in claim 7 wherein the means for extracting comprises a fluid entrance facing tangentially in the fluid flow passage in the opposite sense of rotation from the power liquid jet inlet.

9. A vortex jet pump comprising:

a pumped fluid suction inlet;

a fluid outlet downstream from the suction inlet;

a fluid passage between the suction inlet and the outlet;

a power liquid jet inlet for injecting power liquid into the fluid passage in a generally tangential direction;

a throat in the fluid passage downstream from the power liquid jet inlet having a flow cross section less than the flow cross section of the passage adjacent the power liquid jet inlet;

a diffuser section in the fluid passage downstream from the throat and including means for converting primarily circumferential fluid flow to primarily axial fluid flow in the passage; and means upstream from the power liquid jet inlet for injecting fluid into the fluid passage in a primarily tangential direction with the velocity head of the injected fluid being less than the velocity head of the power liquid injected through the power liquid jet inlet comprising a plurality of booster circuits each extracting fluid from the fluid passage at a downstream location and reinjecting such fluid at an upstream location.

10. A vortex jet pump comprising:

a pumped fluid suction inlet;

a fluid outlet downstream from the suction inlet;

a fluid flow passage between the suction inlet and the outlet;

a power liquid jet inlet for injecting power liquid into the fluid flow passage in a generally tangential direction; and a plurality of means for injecting fluid in the fluid flow passage in a generally tangential direction upstream from the power liquid jet inlet, each successive means for injecting, in a downstream sequence, having a higher fluid velocity head than such means for injecting upstream therefrom, for inducing a vortex in the fluid flow passage upstream from the power liquid jet inlet, said vortex increasing gradually and progressively in the downstream direction wherein the means for injecting comprises a plurality of booster circuits each extracting fluid from the fluid flow passage at a downstream location and reinjecting such fluid at an upstream location.

11. A fluid jet pump comprising:

a pumped fluid suction inlet;

a fluid outlet;

a fluid flow passage between the suction inlet and the outlet;

a power liquid jet inlet aligned with the fluid flow passage in a direction for injecting power liquid into the fluid flow passage in a generally tangential direction;

means for extracting a portion of fluid from the fluid flow passage downstream from the power liquid jet inlet;

means for injecting the portion of fluid into the fluid flow passage in a generally tangential direction upstream from the power liquid jet inlet for inducing a vortex in the fluid flow passage upstream from the power liquid jet inlet.

* * * * *

UNITED STATES PATENT AND TRADEMARK OFFICE

CERTIFICATE OF CORRECTION

PATENT NO. : 4,101,246

DATED : July 18, 1978

INVENTOR(S) : JOHN W. ERICKSON

It is certified that error appears in the above-identified patent and that said Letters Patent are hereby corrected as shown below:

Column 3, Line 42, "pasage" should be --passage--.

Column 5, Line 20, "disclosed" should be --described--.

Column 6, Line 29, --being-- should be inserted after "fluid".

Column 7, Line 21, --flow-- should be inserted after "fluid" and before "passage".

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*